US008902065B2

(12) United States Patent
Willis et al.

(10) Patent No.: US 8,902,065 B2
(45) Date of Patent: Dec. 2, 2014

(54) SECURITY ALARM SYSTEM DEVICE AND COMPONENT FOR SECURING OUTDOOR APPLIANCES

(71) Applicants: Jonathan Willis, Tempe, AZ (US); Stan Willis, Tempe, AZ (US)

(72) Inventors: Jonathan Willis, Tempe, AZ (US); Stan Willis, Tempe, AZ (US)

( * ) Notice: Subject to any disclaimer, the term of this patent is extended or adjusted under 35 U.S.C. 154(b) by 32 days.

(21) Appl. No.: 13/752,699

(22) Filed: Jan. 29, 2013

(65) Prior Publication Data

US 2013/0194095 A1 Aug. 1, 2013

Related U.S. Application Data

(60) Provisional application No. 61/592,328, filed on Jan. 30, 2012.

(51) Int. Cl.
*G08B 13/14* (2006.01)
*G08B 13/12* (2006.01)

(52) U.S. Cl.
CPC ..... *G08B 13/12* (2013.01); *G08B 13/126* (2013.01)
USPC ..... 340/568.1; 340/686.1; 340/693.1

(58) Field of Classification Search
USPC ..... 340/568.1–568.4, 603, 626, 573.1, 340/573.4, 686.1, 687, 541, 550, 545.1, 340/635, 652, 546, 438, 693.1
See application file for complete search history.

(56) References Cited

U.S. PATENT DOCUMENTS

| | | | | |
|---|---|---|---|---|
| 3,090,948 | A | 5/1963 | Cremer | |
| 4,873,936 | A | 10/1989 | Ponticelli | |
| 6,655,648 | B2 | 12/2003 | Harris | |
| 7,549,439 | B2 * | 6/2009 | Kimura et al. | 137/487.5 |
| 7,812,734 | B2 * | 10/2010 | Hardin | 340/652 |
| 7,834,772 | B2 * | 11/2010 | Frederick | 340/626 |
| 8,001,797 | B2 | 8/2011 | Tidrick | |
| 8,130,100 | B2 * | 3/2012 | Barger | 340/568.1 |
| 8,596,099 | B1 * | 12/2013 | Eldred | 70/18 |
| 2003/0193006 | A1 | 10/2003 | Harris | |
| 2003/0201892 | A1 * | 10/2003 | Chance et al. | 340/568.2 |
| 2012/0126971 | A1 * | 5/2012 | Robinson, Jr. | 340/539.11 |
| 2012/0200413 | A1 | 8/2012 | Spurlin | |
| 2012/0256746 | A1 * | 10/2012 | Dunson | 340/568.1 |

* cited by examiner

*Primary Examiner* — Daniel Previl
(74) *Attorney, Agent, or Firm* — Venjuris P.C.

(57) ABSTRACT

In various representative aspects, a security alarm system for protecting an HVAC unit from theft. The system includes an alarm; a control box; a switch connector comprising two terminals, as well as an open state and a closed state; and a fastener that holds the switch connector in the close position while connected to an HVAC unit. The conductors connect the switch connector to the control box, forming a circuit. The control box can apply an energy potential across the circuit, detect an energy flow across the circuit, and trigger the alarm if the energy flow stops. Normally, the terminals do not touch each other, and the switch connector is in its open state. When they touch each other, the switch connector goes to its closed state. If the fastener is removed from the HVAC unit, the switch connector returns to the open state and triggers the alarm.

18 Claims, 4 Drawing Sheets

SECURITY ALARM SYSTEM DEVICE AND COMPONENT FOR SECURING OUTDOOR APPLIANCES

CROSS-REFERENCE TO RELATED APPLICATIONS

The present application claims priority to U.S. provisional patent application entitled "Security Alarm System Device and Component for Securing HVAC Units," having Ser. No. 61/592,328, filed on Jan. 30, 2012, which is entirely incorporated herein by reference.

BACKGROUND OF THE INVENTION

1. Field of the Invention

This invention relates generally to home and business security alarm systems for securing outdoor appliances, and in particular to a security alarm system component for securing HVAC units.

2. Description of the Related Art

As the price of metal goes higher, theft of appliances with metal components increases. Some appliances, such as HVAC units, are typically located outdoors and generally unattended, which makes them easy targets for thieves.

There are many different options available on the market for securing unattended appliances. Most of them set off an alarm when a power cord or a coolant tube is sectioned. Some of these mechanisms use wires attached to the power cord or coolant tube. The wires form a closed circuit. When a wire is cut, causing the circuit open, the alarm is triggered. This type of systems is easy to compromise. The wires are generally affixed to the part of a power cord or coolant tube that is outside the appliance, and an experienced thief may cut a power cord or a coolant tube along the outer surface of an appliance without touching the wires.

Other systems for securing HVAC units detect fluid pressure inside the coolant tubes. When a coolant tube is sectioned, the fluid pressure drops and sets off the alarm. This kind of systems is relatively harder to compromise. But they require replacing or cutting open the coolant tube for installing pressure sensors if the alarm system is not installed at the same time with the HVAC unit. The installation cannot be done by lay persons because not only it may be too dangerous or complex but also tampering with an appliance may void the warranty.

Some systems set off an alarm when the copper inside the appliance is removed. See. e.g., U.S. Patent Application Publication No. US2003/0201892 A1 (the "Chance" application). In Chance, tethers are soldered to copper components inside an HVAC unit and connected to pressure switches. The pressure switches normally maintain the alarm system circuit in a closed position. When a component is taken out of the HVAC unit, the tether attached to the component is pulled against the pressure switch which then opens the alarm system circuit and triggers the alarm. Again, installation of such systems is not a task for lay persons.

What is needed is a security alarm system for securing outdoor appliances that is both effective and easy to install. It is also desirable that such a system is inexpensive.

SUMMARY OF THE INVENTION

The invention is summarized below only for purposes of introducing embodiments of the invention. The ultimate scope of the invention is to be limited only to the claims that follow the specification.

Generally, the present invention comprises a security device that is effective in securing outdoor appliances, easy to install even for lay people, and relatively inexpensive.

There are three major threats when it comes to outdoor appliances, such as HVAC units.

theft of just the copper that is inside the unit;

theft of the entire unit; and, a multistage threat: (1) theft of the copper from a unit, and (2) theft of the entire system once the victim replaces the damaged unit with a brand new unit.

The present invention detects not only unauthorized entry into the unit but also theft of the entire unit. For a thief to access the copper inside the unit, a cover of the unit, such as the lid, a side wall, or an access panel, must be removed. To remove the cover, the thief must remove the fasteners securing, or at least attached to, the cover. Similarly, to take the entire unit away, the thief must remove the fasteners securing the entire unit to the base. This invention detects the unauthorized entry into the unit or the relocation of the unit by detecting whether a fastener is removed or even just loosened.

For a "Stand Alone" embodiment of this invention for securing an outdoor appliance like an HVAC unit, an alarm-triggering event will cause a high volume siren to sound. Preferably, this siren may sound for 1 minute and then reset itself. If the threat still exists, the alarm may continue to sound. The alarm will only stop when it is either disarmed, destroyed or the batteries die. The intent is to scare the thief away before he is able to cause any serious damage to the unit. The Stand Alone embodiment may include a wireless controller to arm/disarm the system.

The preferred embodiment of this invention is a security alarm system ("system embodiment") that comprises: (1) an alarm, (2) a control box, (3) at least one switch connector with two terminals, (4) two conductors, and (5) at least one fastener for attaching the system to the appliance to be secured.

The alarm can be anything that can cause attention to owners, neighbors, the police, or any person responsible to respond to the theft. Sounders, such as electronic sirens, lights, such as strobe lights, remote alarm systems, such as automatic phone calls to the responder, or a combination of these alarms may be adopted.

The control box is a device that can provide an energy potential, such as a low voltage output, to the system. It can also detect an energy flow, such as an electric current flow, and trigger the alarm if the energy flow drops below a certain threshold, indicating an open circuit.

The switch connector has two terminals that normally do not touch each other. The terminals may be made of elastic, conductive materials, such as metal spring clips. When the terminals are not in contact, the switch connector is in its default state, the "open state." But when a force is applied to the terminals to hold the terminals together, the switch connector turns into its "closed state." When the force is gone, the terminals will separate and the switch connector will return to its open state.

Two conductors, such as electric wires, are used to connect the terminals of the switch connector to the control box so that a circuit for an energy flow is created.

The system also has at least one fastener used to attach the system to the appliance to be secured and hold a switch connector in its closed status. If the fastener is loosened or removed, the switch connector will return to its open state. To install this embodiment, the fastener is preferred to replace an original mounting screw of the appliance. Alternatively, the fastener may be attached to the appliance without replacing the mounting screw, but being as close to the mounting screw as possible. This way, a thief would have to loosen the fastener prior to opening the cover or relocating the entire appliance.

Moreover, the system may have a flexible conduit, such as a cable tidy tube, that houses the conductors to protect them from damage and tidy them if the conductors are long and can be easily tangled. To protect the system from ground faults and surges, non-conductive spacers may be used to insulate the fastener and the switch connector from the appliance and to insulate the switch connector from the fastener. The switch connector may also have a holder that stabilizes and separates the terminals. The holder is preferred to be non-conductive, such as a plastic base with two slots for the terminals.

Finally, when the system is set up, the control box applies an energy potential between the two conductors, and the two terminals of the switch connector. If the terminals are connected, an energy flow, such as an electric current, runs in the circuit, which can be detected by a sensor in the control box. So if any alarm-triggering events happen and stop or reduce the energy flow, the control box will find the energy flow drops below a predetermined threshold and then set off the alarm.

An alarm-triggering event can be when the switch connector returns to its open state because fasteners are loosened. Another alarm-triggering event can be when a conductor is cut because the conductor is attached to the power cord of the appliance which a thief severs. In addition, when a switch connector is secured to the unit's circuit breaker box, if a thief attempts to turn off the power of an A/C unit prior to trying to access the unit, the triggering event may be the thief's switching the box to the off position.

Another preferred embodiment is a security component ("component embodiment") used with a preexisting security alarm system. Preexisting security alarm systems generally have an alarm. The security component may work with a preexisting security alarm system that has a control box that can apply an energy potential, detect an alteration of energy flow, and trigger an alarm after detecting the alteration of energy flow. The security component comprises: (1) at least one switch connector with two terminals, (2) two conductors, and (3) at least one fastener for attaching the system to the appliance to be secured. The switch connector, conductors, and the fastener generally work the same way as those of the system embodiment.

On a "Monitored" Version of this component embodiment, the control box of the preexisting security system will detect an alarm-triggering event and send a signal to the alarm system. Normally, it will then sound the alarm systems main siren as well as send a burglary in progress signal to a central station, which can then dispatch the police.

One object of the invention is to provide an inexpensive security alarm system that is effective in securing an outdoor appliance and easy to install even for lay people.

Another object of the invention is to provide an inexpensive security component that is both effective and easy to install and can work with a preexisting security alarm system.

BRIEF DESCRIPTION OF THE DRAWINGS

FIG. 2 shows the switch connecter in the open state.

DESCRIPTION OF EMBODIMENTS

Figure 1:
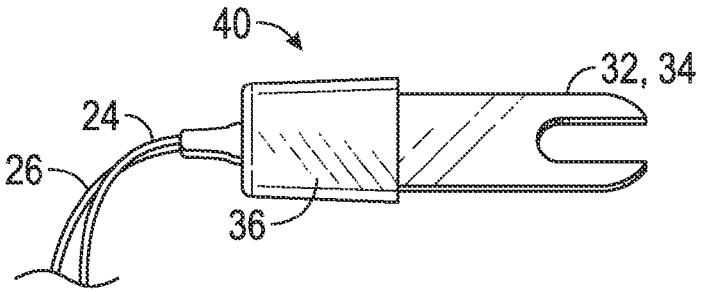
FIG. 1 is a side view of the switch connector of an embodiment.

It is to be understood that the descriptions below are merely illustrative of various embodiments of the invention and that no limitations are intended to the detail of construction or design herein shown other than as defined in the appended claims.

The invention detects unauthorized entry into or removal of outdoor appliances and serves as an inexpensive security device that helps prevent theft and vandalism. A preferred system embodiment, the security device, is shown in FIGS. 1-7. As shown in FIG. 5, the security device 1 for use with an HVAC unit 10 comprises an alarm 22; a control box 20; a flexible conduit 30; a plurality of switch connectors 40, each comprising a first terminal 32 and a second terminal 34 (shown in FIG. 1); and a plurality of fasteners 50.

The control box 20 in FIG. 5 can (1) apply an energy potential across a first conductor 24 and a second conductor 26 (both shown in FIG. 1; and inside the flexible conduit 30 in FIG. 5), (2) detect an alteration of energy flow across the first conductor 24 and second conductor 26, and (3) trigger the alarm 22 after detecting the alteration of energy flow.

The flexible conduit 30 in FIG. 5 houses the first conductor 24 and the second conductor 26 (in FIG. 1). The first end of the flexible conduit 30, the first conductor 24, and the second conductor 26 are connected to the control box 20.

Figure 2:
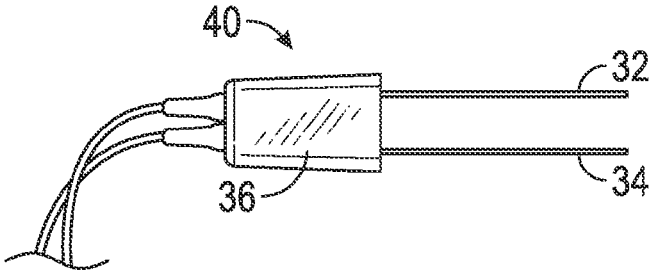
FIG. 2 is a side view of the switch connector rotated 90 degrees from the side view in FIG. 1.
Figure 3:
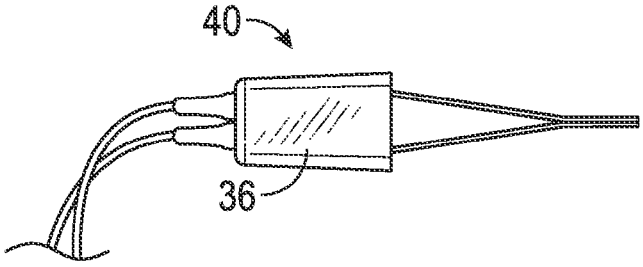
FIG. 3 is the same view as FIG. 2 except the switch connector is in the closed state.

As shown in FIGS. 1-3, the first terminal 32 of the switch connector 40 is connected to the first conductor 24 and the second terminal 34 is connected to the second conductor 26. The switch connector 40 has an open state and a closed state. The open state, which is the default state for the switch connector 40, is when the first terminal 32 and second terminal 34 do not touch each other, as shown in FIG. 2. The closed state is when the first terminal 32 and second terminal 34 touch each other, as shown in FIG. 3. The holder 36 is used to separate the first terminal 32 and the second terminal 34 so that they do not touch each other in the default state, the open state.

Figure 4:
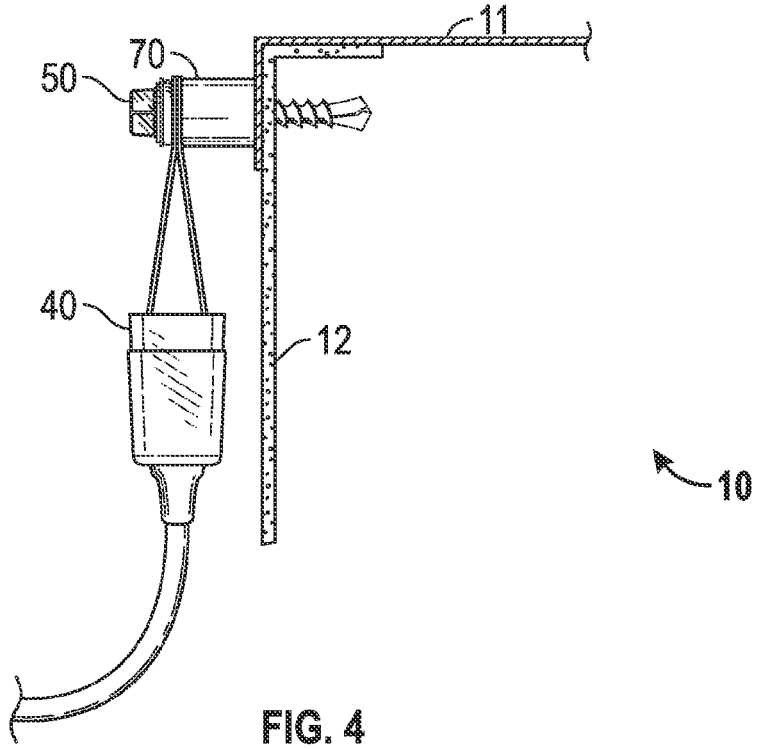
FIG. 4 shows a cut view of an HVAC unit having a switch connector fastened to the HVAC unit with a fastener.
Figure 5:
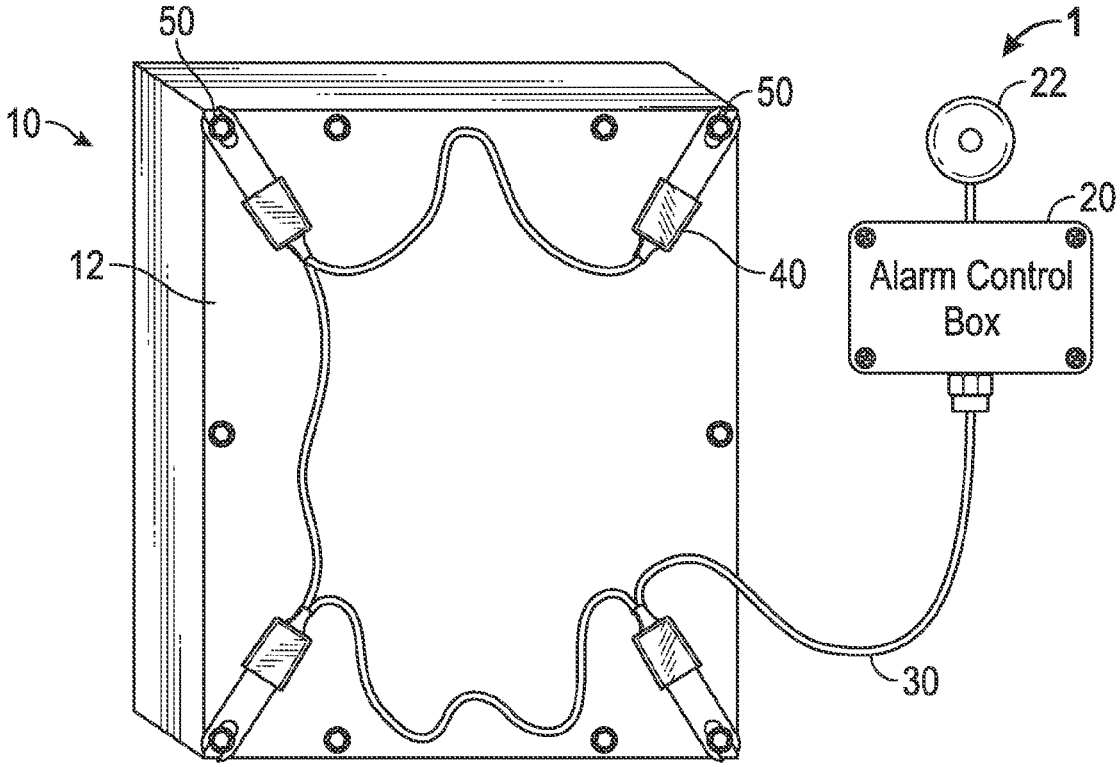
FIG. 5 shows a preferred system embodiment.

As shown in FIG. 4, the fastener 50 holds the switch connector 40 in a closed position while connected to an HVAC unit 10, securing the lid 11 to the side wall 12. But if the fastener 50 is removed from the HVAC unit 10, the switch connector 40 will return to the open state and trigger the alarm 22.

Figure 6:
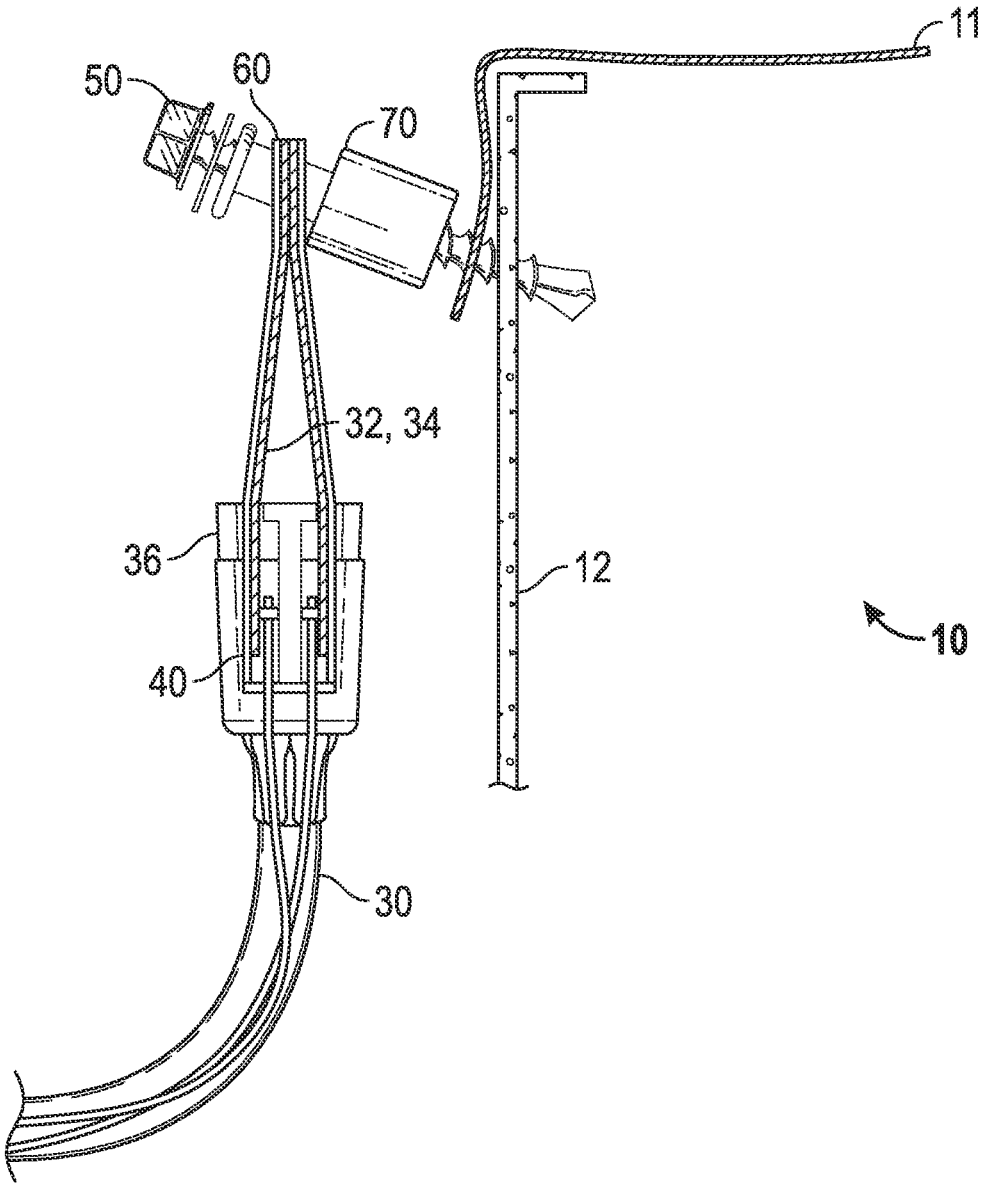
FIG. 6 is a side exploded view of a preferred switch connector.

In FIG. 5, the preferred embodiment has multiple fasteners 50 and multiple switch connectors 40 that are designed to detect an attempt to access the copper inside the unit 10 by opening the side wall 12. In FIG. 6, the switch connector 40 is clipped to the fastener 50 that secures the lid 11 of the A/C Unit 10. An inside spacer 60 and an outside spacer 70 are used here to insulate the fastener 50 and the A/C unit 10 from the switch connector 40, thus protecting the device from ground faults and surges. In the event a fastener 50 is loosened, the switch connector 40 will return to its open state, which will activate the device 1 and trigger the alarm 22.

Figure 7:
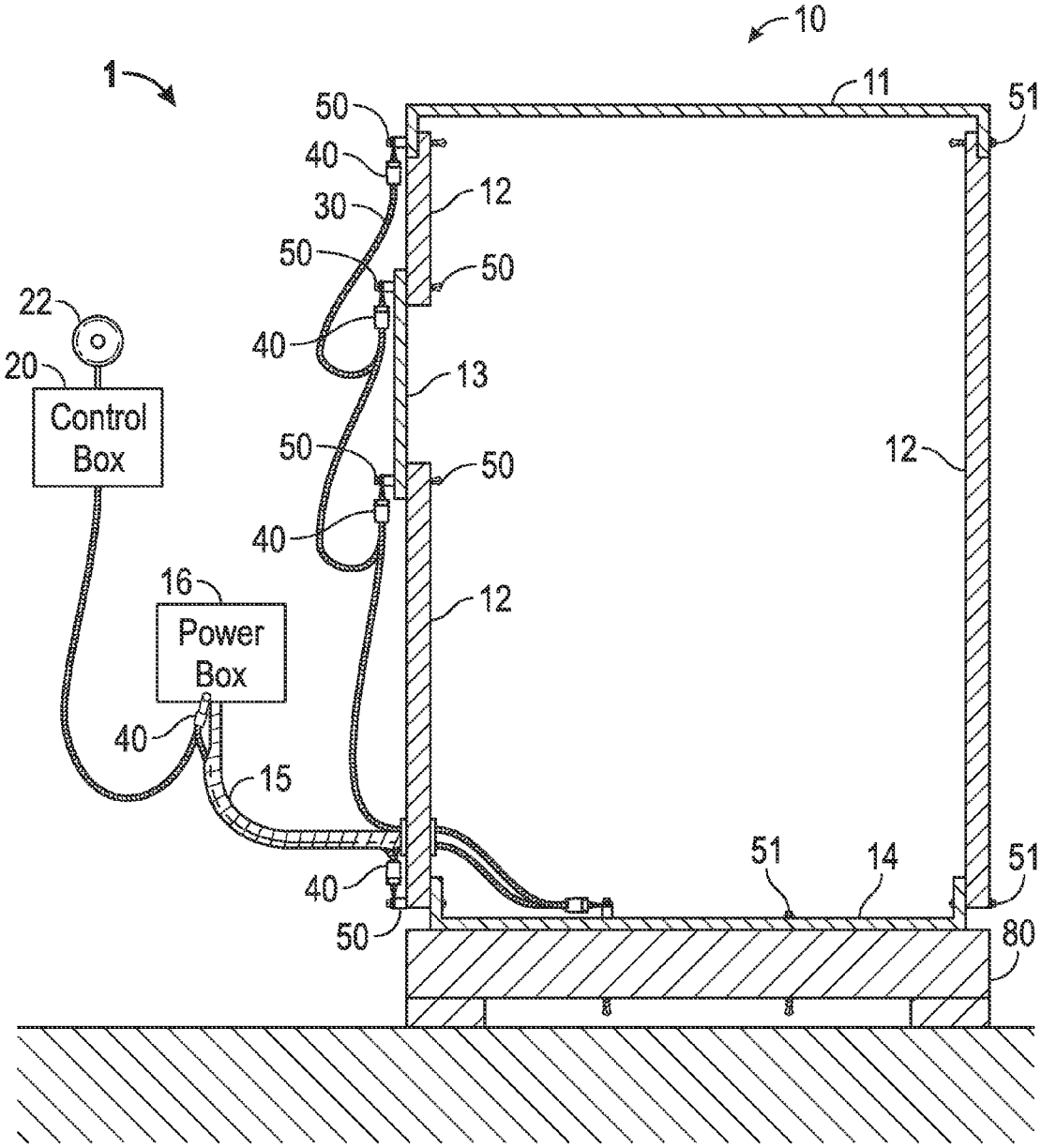
FIG. 7 shows a cut view of an HVAC unit with an embodiment connected to the unit.

Finally, the preferred embodiment 1 may be installed with an A/C unit 10 as show in FIG. 7. In this configuration, fasteners 50 replace some original mounting screws 51. A plurality of fasteners 50 and switch connectors 40 are preferred to secure the lid 11, the access panel 13, the side wall 12, and the base pan 14. If a thief attempts to open the lid 11, the access panel 13, or the side wall 12, or to take the whole unit 10 by removing the base pan 14, the alarm 22 will trigger. In addition, the flexible conduit 30 may be affixed to the power cord 15 of the A/C unit 10 to detect whether the power cord 15 is cut. A fastener 50 and switch connector 40 may also be attached to the power box 16 to detect any unauthorized access to the box 16.

In brief, the preferred embodiment may detect the unauthorized opening of a cover of an appliance as well as the removal of the whole unit. This embodiment may also detect the cutting of the power cord or coolant tubes of the appliance when the conductors are attached to the power cord or coolant tubes. Thus, with the noncomplex but effective design, the invention serves as an inexpensive security solution to the theft of outdoor appliances.

Although the invention has been described in detail with reference to one or more particular preferred embodiments, persons possessing ordinary skill in the art to which this invention pertains will appreciate that various modifications and enhancements may be made without departing from the spirit and scope of the claims that follow.

What is claimed is:

1. A security device for use with an outdoor appliance comprising:

an alarm;

a first conductor and a second conductor;

a control box connected to the alarm, the first conductor and the second conductor, the control box being configured to (1) apply an energy potential across the first conductor and the second conductor, (2) detect an alteration of energy flow across the first and second conductor, and (3) trigger the alarm after detecting the alteration of energy flow;

a switch connector comprising:

(1) a first terminal and a second terminal, the first terminal being connected to the first conductor and the second terminal being connected to the second conductor, and (2) an open state and a closed state, the open state being where the first and second terminals do not touch each other and the closed state being where the first and second terminals touch each other, the open state being the default state; and, a fastener coupled to the switch connector, holding the switch connector in the closed state while the fastener connected to the outdoor appliance, and letting the switch connector return to the open state and trigger the alarm while the fastener removed from the outdoor appliance.

2. The security device in claim 1 further comprises a flexible conduit that houses the first conductor and the second conductor.

3. The security device in claim 1 further comprises an outside spacer that insulates the fastener and the switch connector from the outdoor appliance when the fastener is connected to the outdoor appliance.

4. The security device in claim 1 further comprises an inside spacer that insulates the switch connector from the fastener when the fastener is holding the switch connector.

5. The security device in claim 1, wherein the switch connector further comprises a holder that stabilizes and separates the first and second terminals.

6. The security device in claim 1, wherein the fastener replaces a mounting fastener of the outdoor appliance.

7. A security component for use with a security alarm system having a control box, where the control box can (1) apply an energy potential across a first conductor and a second conductor, (2) detect an alteration of energy flow across the first and second conductor, and (3) trigger an alarm after detecting the alteration of energy flow, the security component comprising:

the first conductor and the second conductor, both being connected to the control box;

a switch connector comprising:

(1) a first terminal and a second terminal, the first terminal being connected to the first conductor and the second terminal being connected to the second conductor, and (2) the switch connector further comprising an open state and a closed state, the open state being where the first and second terminals do not touch each other and the closed state being where the first and second terminals touch each other, the open state being the default state; and, a fastener, coupled to the switch connector, configured to hold the switch connector in the closed state while the fastener is connected to an HVAC unit, and configured to let the switch connector return to the open state and trigger the alarm while the fastener is removed from the HVAC unit.

8. The security component in claim 7 further comprises a flexible conduit that houses the first conductor and the second conductor.

9. The security component in claim 7 further comprises an outside spacer that insulates the fastener and the switch connector from the HVAC unit when the fastener is connected to the HVAC unit.

10. The security component in claim 7 further comprises an inside spacer that insulates the switch connector from the fastener when the fastener is holding the switch connector.

11. The security component in claim 7, wherein the switch connector further comprises a holder that stabilizes and separates the first and second terminals.

12. The security component in claim 7, wherein the fastener replaces a mounting fastener of the HVAC unit.

13. A kit of security components for use with a security alarm system having a control box, where the control box can (1) apply an energy potential across a first conductor and a second conductor, (2) detect an alteration of energy flow across the first and second conductor, and (3) trigger an alarm after detecting the alteration of energy flow, the kit comprising:

the first conductor and the second conductor, to be connected to the control box;

a switch connector comprising:

(3) a first terminal and a second terminal, the first terminal being connected to the first conductor and the second terminal being connected to the second conductor, and (4) the switch connector further comprising an open state and a closed state, the open state being where the first and second terminals do not touch each other and the closed state being where the first and second terminals touch each other, the open state being the default state; and, a fastener, to be coupled to the switch connector, configured to hold the switch connector in the closed state while the fastener is connected to an HVAC unit, and configured to let the switch connector return to the open state and trigger the alarm while the fastener is removed from the HVAC unit.

14. The kit in claim 13 further comprises a flexible conduit that houses the first conductor and the second conductor.

15. The kit in claim 13 further comprises an outside spacer, coupled to the fastener and the switch connector in order to insulate the fastener and the switch connector from the HVAC unit when the fastener is connected to the HVAC unit.

16. The kit in claim 13 further comprises an inside spacer, coupled to the switch connector in order to insulate the switch connector from the fastener when the fastener is holding the switch connector.

17. The kit in claim 13, wherein the switch connector further comprises a holder that stabilizes and separates the first and second terminals.

18. The kit in claim 13, wherein the fastener replaces a mounting fastener of the HVAC unit when the fastener is connected to the HVAC unit.

* * * * *